US007237625B2

(12) United States Patent
Minshull et al.

(10) Patent No.: US 7,237,625 B2
(45) Date of Patent: Jul. 3, 2007

(54) DEVICE FOR SIMULATANEOUSLY CASING A HOLE WHILE DRILLING

(76) Inventors: Ronald G. Minshull, 31 Millcrest Road S.W., Calgary, Alberta (CA) T2Y 2K9; Brian Richard Minshull, 31 Millcrest Road S.W., Calgary, Alberta (CA) T2K 2K9

( * ) Notice: Subject to any disclaimer, the term of this patent is extended or adjusted under 35 U.S.C. 154(b) by 241 days.

(21) Appl. No.: 10/522,132

(22) PCT Filed: Jul. 17, 2003

(86) PCT No.: PCT/CA03/01033

§ 371 (c)(1),
(2), (4) Date: Jan. 24, 2005

(87) PCT Pub. No.: WO2004/011764

PCT Pub. Date: Feb. 5, 2004

(65) Prior Publication Data

US 2005/0230153 A1 Oct. 20, 2005

Related U.S. Application Data

(60) Provisional application No. 60/398,990, filed on Jul. 29, 2002.

(51) Int. Cl.
*E21B 3/02* (2006.01)

(52) U.S. Cl. ..... 175/135; 175/171; 175/189; 173/110

(58) Field of Classification Search ..... 175/135, 175/171, 189; 173/104, 109, 110
See application file for complete search history.

(56) References Cited

U.S. PATENT DOCUMENTS

| | | | | | |
|---|---|---|---|---|---|
| 1,870,540 | A | | 8/1932 | Wells | |
| 3,528,498 | A | * | 9/1970 | Carothers | 166/55 |
| 3,833,072 | A | * | 9/1974 | Back | 175/85 |
| 3,895,680 | A | | 7/1975 | Cook | |
| 3,961,672 | A | | 6/1976 | Welsch et al. | |
| 4,232,752 | A | | 11/1980 | Hauk et al. | |
| 4,253,531 | A | | 3/1981 | Boros | |
| 4,296,821 | A | * | 10/1981 | Larson | 175/87 |
| 4,340,120 | A | * | 7/1982 | Hauk et al. | 173/131 |
| 6,029,757 | A | | 2/2000 | Anderson et al. | |
| 6,371,209 | B1 | | 4/2002 | Allyn et al. | |
| 6,409,432 | B1 | | 6/2002 | Beck, III | |
| 6,419,033 | B1 | | 7/2002 | Hahn et al. | |

* cited by examiner

*Primary Examiner*—William P. Neuder
(74) *Attorney, Agent, or Firm*—Paul Smith; Paul Smith Intellectual Property Law

(57) ABSTRACT

A driving device for installing a pipe or casing, without the use of hydraulic or pneumatic means, by capturing the rotational motion of the drill string. The driving device is placed at the top end of the pipe being (42) installed and the drill string (2) passes through the center of the device. The drill string freely rotates, advances or retracts within the driving device, until the driving device is attached (4) to the drill string when required. When the driving device is attached to the drill string, the rotational force of the drill string and any downward force applied to the drill string are captured, and used to install the pipe. The driving device uses the rotation of the drill string to impact a blow to the pipe, driving the pipe downward. The driving device uses any downward force applied to the drill string to maintain downward pressure on the pipe.

41 Claims, 8 Drawing Sheets

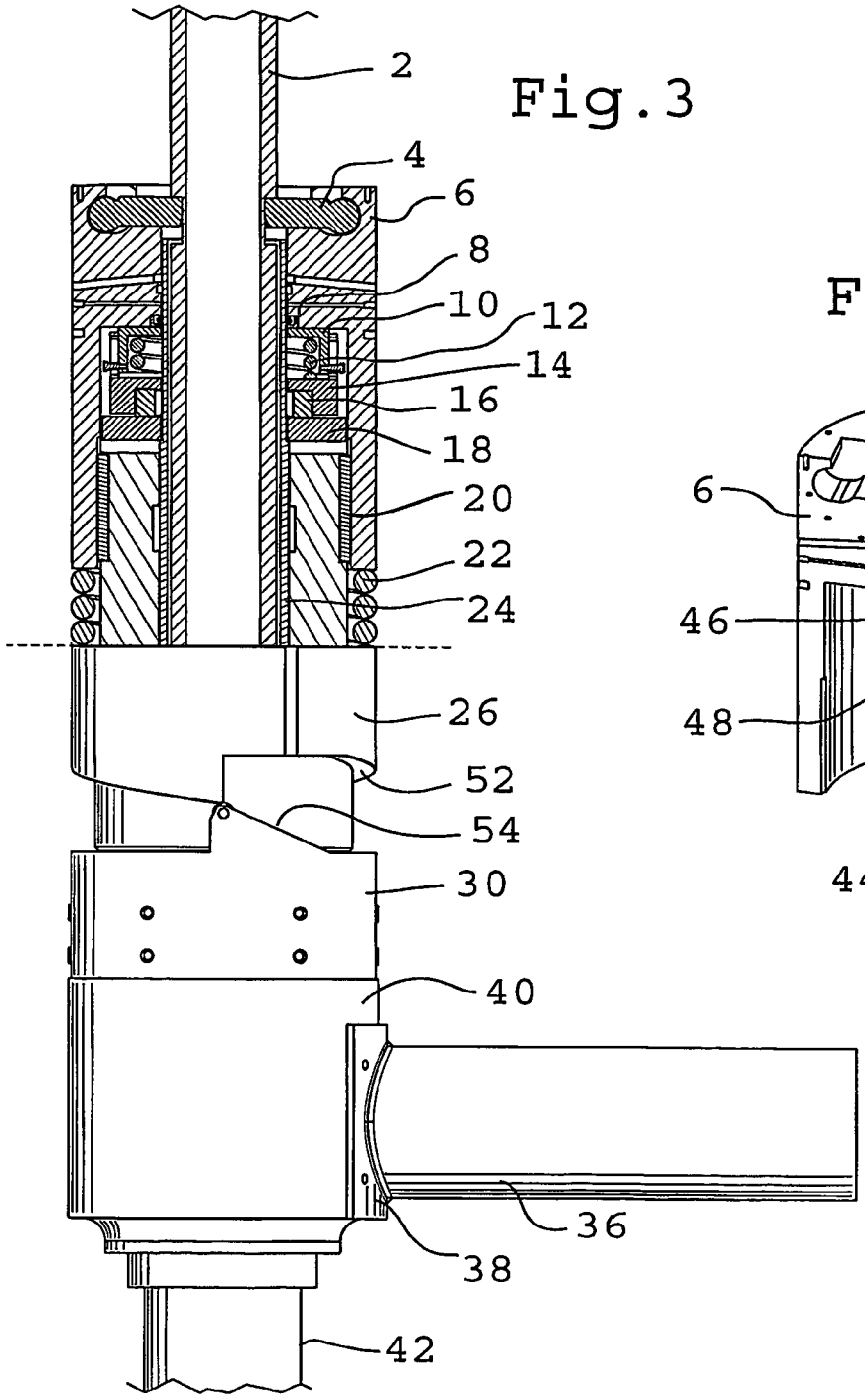
Fig.3
Fig.3A
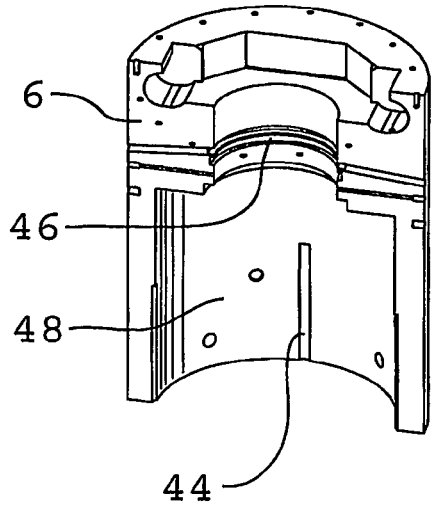

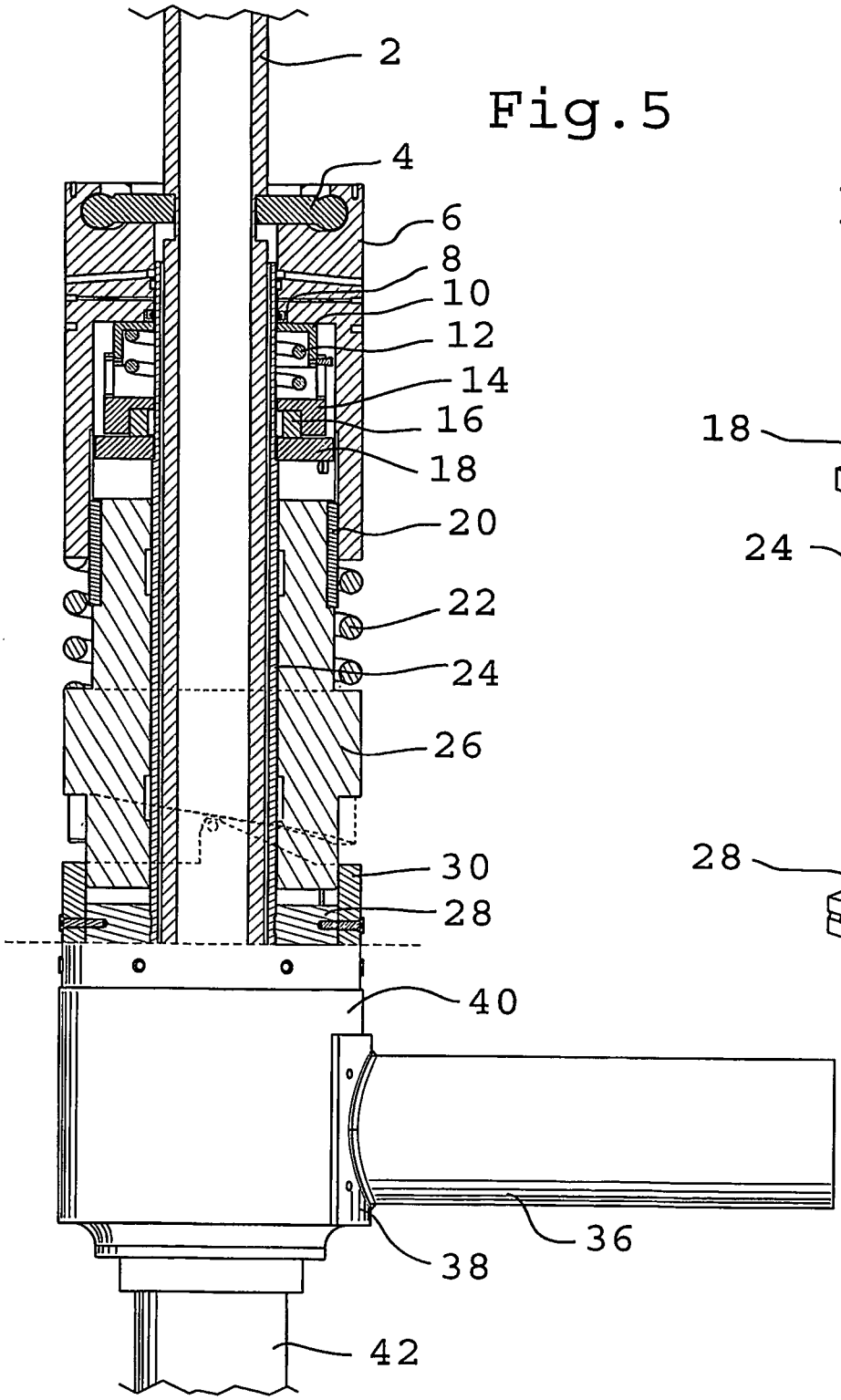
Fig.5
Fig.5A
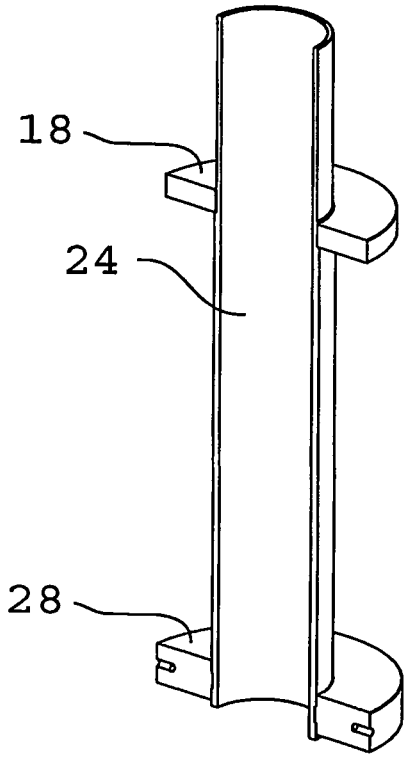

DEVICE FOR SIMULATANEOUSLY CASING A HOLE WHILE DRILLING

CROSS REFERENCE TO RELATED APPLICATION

This application claims priority from Provisional U.S. Patent Application No. 60/398,990, filed Jul. 29, 2002.

TECHNICAL FIELD OF THE INVENTION

This invention relates generally to installation of pipes into a formation, or crust of the earth, while constructing a borehole. More particularly, the invention may be used with different types of rotary drill rigs and rotary devices to install a casing in a hole while the hole is being drilled.

BACKGROUND OF THE INVENTION

Drilling a well hole typically involves drilling to a certain depth with a drill bit mounted on a drill string, then removing the drill string from the hole in order to case the hole. The pipe or casing is driven into the hole by repeated impact. Generally it is not desirable to drill too far down before casing the hole, as the sides of an uncased hole may be susceptible to collapse and to leaks from the surrounding formation. The drill-then-case process has to be repeated several times to produce a deep hole. Drilling a hole can therefore be a time-consuming process. To maximize production and profits, it is necessary to minimize the time spent completing a hole.

Advancing a pipe into the earth usually requires costly, heavy and cumbersome equipment, including a massive driving device to either develop the impact energy or to transmit impact energy to the pipe or casing. The device must be securely mounted on a drill rig, necessitating modifications to the drill rig to be able to handle the driving device. Existing driving devices are generally large and require additional equipment for their operation, such as hydraulic pumps or air compressors. Once installed on a rig, a driving device is usually difficult to remove.

U.S. Pat. No. 3,895,680 to Cook discloses a hammer by which a pipe may be driven into the ground, without any type of drilling mechanism. A heavy, hollow ram is raised by a pair of air cylinders mounted on the outside of the ram. The ram travels downward transmitting a blow to the pipe being installed. The force of the blow is determined by the weight of the ram. The system requires an external source of compressed air and a complex control system. The force of the impact is not adjustable, as might be desired when casing in softer or less dense strata.

Drilling equipment or drilling rigs come in various sizes, with different hoisting systems and various tower configurations. A common approach is to modify the tower and equipment to adapt to the driving device. Due to the size and operational methods, several drilling rigs have towers and hoisting capabilities, which are too small to adapt to the installation of conventional casing driving equipment.

It is known in the art to case the hole while drilling as a means of improving the speed and efficiency of the drilling process. The present invention relies on a simple casing driver which is small, easy to handle and adaptable for various drilling rigs, in contrast to many of the other prior art devices, which rely on heavy, cumbersome machinery and require special handling procedures. Further, the prior art devices, generally being controlled by hydraulic or pneumatic means, require an independent source of power, and controls for that power.

U.S. Pat. No. 3,833,072 to Back illustrates a drilling machine including a casing-driving element. While the device is intended to be relatively low weight and portable, it still requires an external source of hydraulic pressure, and a complex intermittent pressure regulation system to operate the driver.

U.S. Pat. No. 4,232,752 to Hauk et al. employs a lightweight, short stroke annular piston, while increasing the rate of impact on the casing. Each individual impact is low energy, which is compensated by the increased frequency of the impacts. As in Cook, the piston is pneumatically driven. The driver further includes a complex set of valve chambers and passages to maximize the efficiency of pneumatic system.

In U.S. Pat. No. 6,029,757, Anderson et al. disclose a casing hammer assembly containing a central aperture surrounding a drill string. To drive the casing, a reciprocating hammer strikes an impact anvil surrounding the central aperture. Anderson et al. manage to avoid the use of pneumatic or hydraulic means to operate the hammer, instead reciprocating the hammer by use of an eccentric arrangement. This arrangement involves sprockets and chains driven by a rotating shaft and sleeve. The shaft itself is driven by a motor, which requires its own power source. However, the relatively complex arrangement of chains and sprockets between the shaft and the hammer leaves the entire assembly more vulnerable to failure. The use of a separate motor results in an additional part that could fail or need maintenance. Further, the entire assembly is suspended from the drilling rig above the casing pipe by a set of cable pulleys and cables, which could cause problems with the storage of the driver when not in use.

U.S. Pat. No. 6,371,209 to Allyn et al. discloses a device for the removal of casing. The device disclosed by Allyn et al. relies upon an existing pneumatic hammer drill for it to operate, and a source of power. Allyn et al. rotates the pipe or casing to install it, which requires that the ends of the each pipe be threaded.

It is one object of the invention to provide a new method of advancing pipe into the earth.

It is a further object of the invention to provide a method of advancing pipe without the need for air or hydraulics to operate the device.

It is an object of the invention to provide a driving device which is versatile, in that it may be used on virtually any existing drill rigs without modification to the drill rigs in order to use the driver.

It is a further object of the invention to provide a driving device which is easily attached to a string of drilling tools being rotated by a drilling rig or rotating device.

It is a further object of the invention to provide a driving device which, once attached to the drill string, can be selectively operated, allowing the drill crew to drill without hammering, yet without physically removing the driver from the drill string.

These and other objects of the invention will be appreciated by reference to the summary of the invention and to the detailed description of the preferred embodiment that follow. It will be appreciated that all of the foregoing objectives may not be satisfied simultaneously by the preferred embodiment or by each of the claims.

SUMMARY OF THE INVENTION

The invention is a driving device for driving pipes or casing into the ground while a hole is being drilled. The driving device is placed on a rotary drill stem, above the casing. If the driving device is not attached directly to the drill stem, the stem may be rotated, advanced or retracted freely. However, once the driver is clamped to the drill stem, it harnesses the rotational force of the drill stem to provide a vertical impact force to the pipe or casing. Because the driver impacts the casing twice for every rotation of the drill stem, the frequency of the impacts varies with the speed of the drill stem.

The driving device uses the existing rotary drill string and its controls to enable handling and operation functions and to simultaneously install a casing as the hole is drilled. Because the driving device makes contact with the drill string, and uses the downward pressure and rotation of the string to install a casing, there is no need for external hydraulic or pneumatic equipment to operate the driving device.

Because of its simplicity, the driving device is relatively small, and can be transported in a light service truck. The driving device can be used with many types of rotary drilling equipment, or rotating devices, without modifying them.

The device is easily operated by a technician versed in installation of casing while drilling a hole. A machinist, qualified in the operation of milling and lathe equipment, can manufacture the device in a machine shop from available metals.

In one aspect the invention comprises a method of installing a pipe or casing, comprising the steps of capturing rotational force supplied by an external driver, storing energy derived from the rotational force, converting the energy to an impact force, and transmitting the impact force to the pipe or casing. The invention may further comprise capturing a downward force applied to the external driver and transmitting the downward force to the pipe or casing.

In one embodiment, the invention relates to a device, using an external driver, to install a pipe or casing, comprising a first portion adapted to capture an axial rotational force supplied by the external driver along a central axis, a second portion adapted to store energy derived from the external driver's rotational force and to convert the stored energy to an impact force, and a third portion adapted to transmit the impact force to the pipe or casing. The invention may further comprise a fourth portion, namely a shaft shaped to encircle the external driver while fitting within the first, second and third portions along the central axis.

In one aspect of the first embodiment of the invention, the first portion of the invention may comprise a carrier device surrounding a section of the external driver, and means, such as slips or clamps, to connect the carrier device to the external driver. The carrier device may comprise a generally hollow cylinder, adapted to accommodate a section of the external driver through an axially central aperture and to accommodate part or all of the second portion of the device.

In a further aspect, the second portion may comprise an upper portion, which rotates about a central axis under the rotational force of the driver, and a lower portion. The upper and lower portions may further comprise facing inclined surfaces which cooperate to move the upper portion away from the lower portion along the central axis upon partial rotation of the upper and lower portions, and further cooperate to allow the upper portion to move back towards the lower portion along the central axis upon further relative rotation of the upper and lower portions. The further cooperation may comprise a sudden cessation of direct contact between the inclined surfaces.

In another aspect, the invention may include at least one spring, which compresses and expands as the upper portion and lower portion move away from and toward each other.

In a further aspect, the third portion may comprise an upper surface, adapted to receive an impact force from the second portion, and a lower surface in direct contact with an uppermost part of the pipe or casing. The third portion may further comprise an outlet to allow air to escape from the third portion.

In another embodiment, the invention comprises a device for installing a pipe or casing using an external rotary driver which produces a rotational force, comprising means to directly connect the device to the external rotary driver, a central shaft encircling a portion of the external rotary driver, a hammer, an anvil, one or more springs and a generally cylindrical carrier device. The carrier device and hammer may be operatively connected to rotate in concert under the rotational force, such that the rotational force causes the hammer to provide a first impact force to the anvil, and the first impact force causes the anvil to provide a second impact force to the pipe or casing.

In another embodiment, the invention comprises a device for installing a pipe or casing, using an external driver, comprising a first portion adapted to capture an axial rotational force supplied by the external driver along a central axis, and a second portion adapted to store energy derived from the rotational force, to convert the energy to an impact force and to transmit the impact force to the pipe or casing.

In one aspect, the first portion of this embodiment of the invention may comprise a carrier device surrounding a section of the external driver and means, such as slips or clamps, to connect the carrier device to the external driver. In another aspect, the carrier device may be a generally hollow cylinder, with an axially central aperture to accommodate a section of the external driver and adapted to accommodate part or all of the second portion of the device.

In a further aspect, the second portion may comprise an upper portion, which rotates about a central axis under the rotational force of the driver, and a lower portion. The upper and lower portions may further comprise facing inclined surfaces which cooperate to move the upper portion away from the lower portion along the central axis upon partial rotation of the upper and lower portions, and further cooperate to allow the upper portion to move back towards the lower portion along the central axis upon further relative rotation of the upper and lower portions. The further cooperation may comprise a sudden cessation of direct contact between the inclined surfaces. The second portion may further comprise an outlet to allow air to escape from the second portion.

In another aspect, the invention may include at least one spring, which compresses and expands as the upper portion and lower portion move away from and toward each other.

In another aspect, this embodiment of the invention may further comprise a third portion, namely a shaft shaped to encircle the external driver while fitting within the first and second portions along the central axis.

In another aspect, each embodiment may further comprise means to capture a downward force applied to the external driver, to store the captured downward force, and to transmit the stored downward force to the pipe or casing. One or more springs may be used to capture, store and transmit the downward force, and the transmittal may be essentially constant through the installation procedure.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The preferred embodiment of the invention will be described by reference to the drawings in which:

FIG. 3 is a partial sectional view of the driver of FIG. 1, in an extended, or loaded, position.

FIG. 3A is a perspective cutaway view of the carrier component of the driver.

FIG. 5 is a partial sectional view of the driver of FIG. 1, in a partially loaded position.

FIG. 5A is a perspective cutaway view of the sub anvil component of the driver.

DETAILED DESCRIPTION OF THE PREFERRED EMBODIMENT OF THE INVENTION

Figure 1:
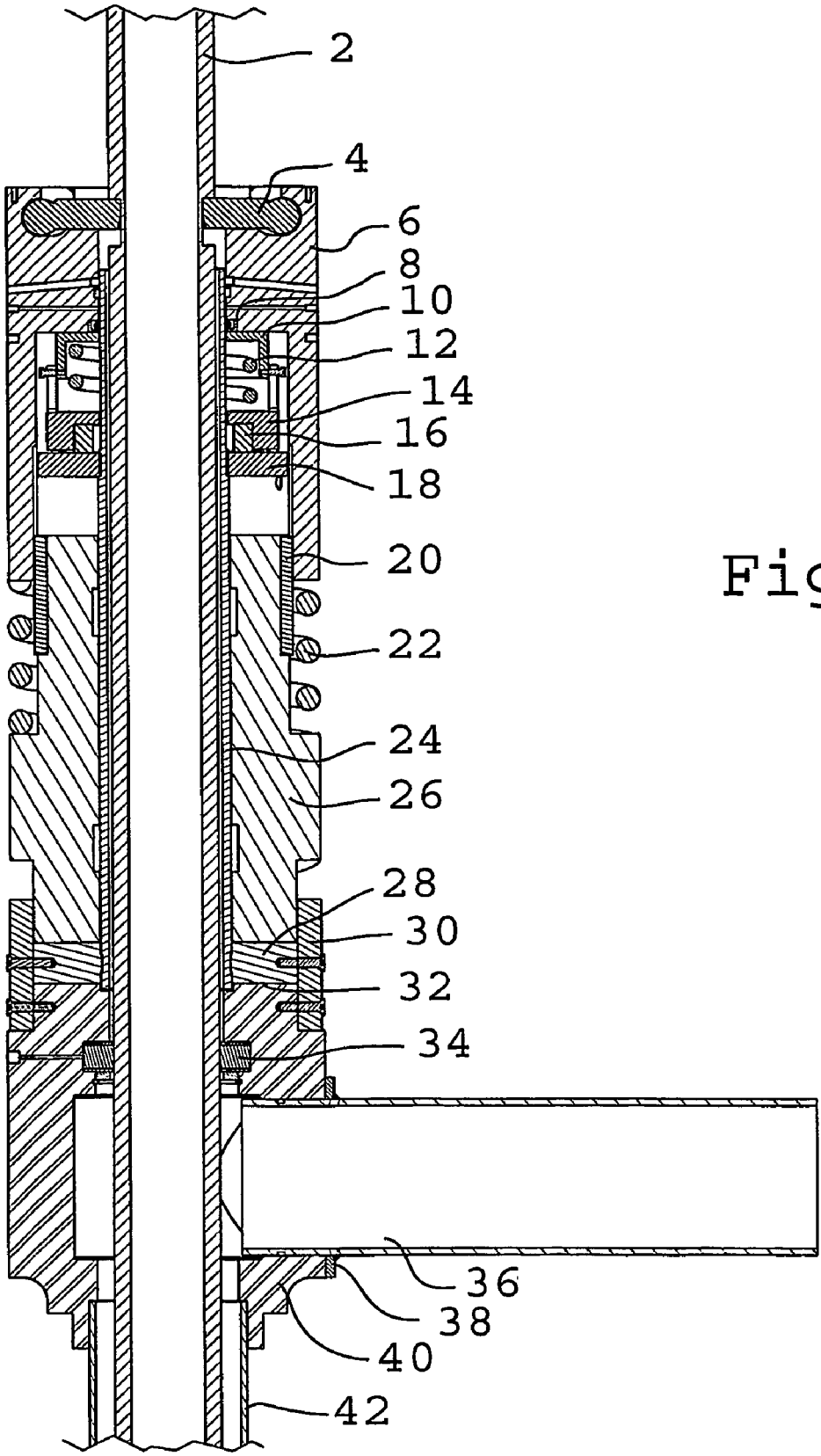
FIG. 1 is a sectional view of the driver, clamped into place on a drill stem above a pipe or casing.

Referring to FIG. 1, the invention relates to a driving device which may be installed directly on a drill stem 2 to assist in driving a pipe or casing 42 into the ground. In operation, the driver is attached directly to drill stem 2 via any suitable mechanism, such as clamps or slips 4. Anvil 40, at the lowermost end of the driving device, rests on the top edge of pipe or casing 42. When the drill stem 2 is to be operated without hammering a pipe or casing 42, clamps or slips 4 may be released, allowing free rotation, advancement or retraction of the drill stem 2 without affecting the driving device.

Figure 2:
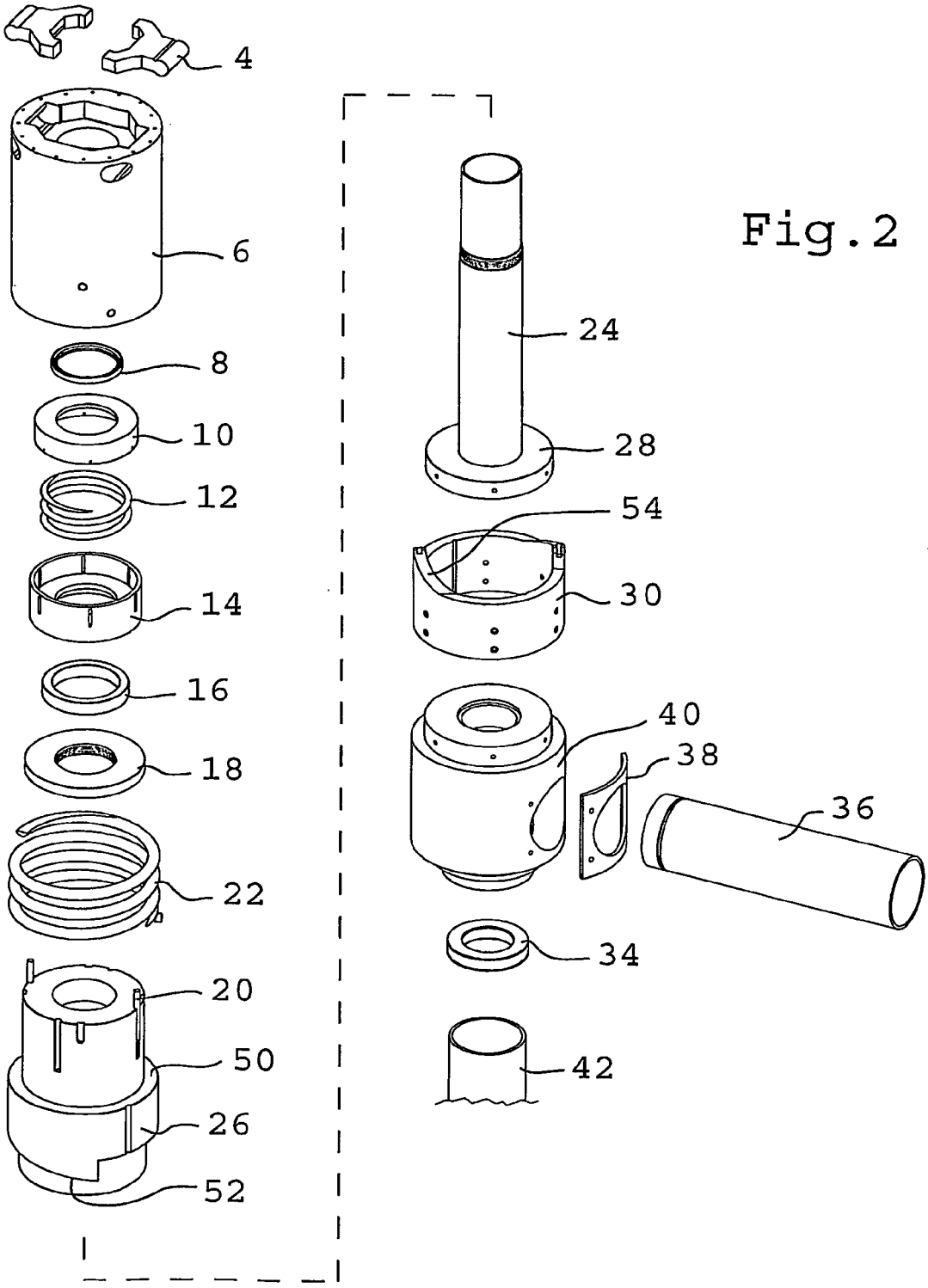
FIG. 2 is an exploded view of the driver.

The individual components of the preferred embodiment of the invention are best shown in FIGS. 1 and 2. Clamps or slips 4 rest on top of carrier 6. Carrier 6 (best illustrated in FIG. 3A) is a generally cylindrical piece with a central aperture 46 through which the drill stem 2 (shown in FIG. 1 only) extends. In the preferred embodiment of the invention, the topside of carrier 6 is formed to securely hold clamps or slips 4, though it will be understood that clamps or slips 4 may be attached to carrier 6 in any appropriately secure manner. The underside 48 of carrier 6 is hollow, the purpose of which is explained below.

Typically, a downward force is applied to drill stem 2, via pull down chains or like equipment. Inner advance spring 12 captures the downward force applied to drill stem 2, as explained below. Inner advance spring 12 may be encased, for example, in a spring carrier, which may comprise a top section 10 and bottom section 14. The spring carrier is intended to hold inner advance spring 12 in an optimum vertical position, allowing for the most efficient energy transfer during operation of the driving device.

Dust seals, such as those illustrated at 8 and 34, may be employed to seal the assembly and prevent damage that may be caused by flying debris during drilling and driving operations.

Thrust bearing 16 and sub anvil receiver plate 18 between inner advance spring 12 and outer hammer spring 22 distribute all vertical forces evenly around the circumference of the driving device, ensuring all forces are properly vertically directed. This ensures that pipe or casing 42 is being driven or pulled exactly in the desired direction, without wasting energy by dissipating it laterally from the driving device.

Hammer 26 comprises a generally cylindrical piece, with a central aperture. The diameter of the upper portion of hammer 26, which shall be referred to as the upper cam surface, is such that it fits inside the hollow underside 48 of carrier 6, with the central aperture 46 of carrier 6 and the central aperture of hammer 26 being generally aligned. A partial view of hammer 26 is shown in FIG. 4A.

Outer hammer spring 22 is sized to fit around the outside of the upper cam surface of hammer 26. A diametrically larger portion of the hammer 26 creates a shoulder 50 around the circumference of hammer 26. The shoulder 50 prevents outer hammer spring 22 from completely sliding down around hammer 26. Outer hammer spring 22 is thereby kept in place between the shoulder 50 and the lowermost edge of carrier 6.

FIG. 1 best illustrates the interconnection of carrier 6 and hammer 26 to contain the upper dust seal 8, inner advance spring 12, inner spring carrier 10, 14, thrust bearing 16 and sub anvil receiver plate 18 in the hollow underside 48 of carrier 6, as well as the placement of outer hammer spring 22.

When assembling the driving device, sub anvil 24 is threaded through the central aperture of hammer 26, such that hammer 26 rests on a lower impact plate 28 at the bottom of the sub anvil. The lower impact plate 28 may be used to hold the hammer 26 in the proper position relative to sub anvil 24, as well as to evenly distribute any downward impact of the hammer 26. Sub anvil receiver plate 18, thrust bearing 16, inner spring carrier 10, 14, inner advance spring 12 and upper dust seal 8 are likewise threaded onto sub anvil 24. The assembly is topped with carrier 6, with sub anvil 24 partially extending through the central aperture 46 of carrier 6.

Sub anvil 24 provides a stable central shaft for the driving device, which allows the driving device to surround drill stem 2 without interference unless slips or clamps 4 are engaged to fasten the driving device to the drill stem 2. While FIG. 1 shows sub anvil 24 with an inner diameter just larger than the outer diameter of drill stem 2, sub anvil 24 also allows the use of the driving device on a drill stem 2 with a narrower diameter. The inner diameter of sub anvil 24 is preferably sufficiently large that drill stem 2 does not interfere with sub anvil 24, or cause it to rotate.

Means such as splines 20 (best shown in FIGS. 1 and 2) may be used to interlock the upper cam surface of hammer 26 with grooves 44 in the underside 48 of carrier 6 (as shown in FIG. 3A), thereby ensuring that rotation of drill stem 2 is properly transmitted to hammer 26. Hammer 26 and carrier 6 therefore move in concert.

The lower edge of the diametrically enlarged portion of hammer 26 comprises an inclined surface 52. The inclined surface 52 interacts with the upper surface 54 of cam 30, which is likewise inclined. Inclined surfaces 52, 54 culminate in one or more points or tips. Wheel or roller devices may be placed at the points or tips, to ensure smooth interaction of inclined surfaces 52, 54. The interaction of the inclined surfaces 52, 54 is explained in more detail below.

The bottom surface of lower impact plate 28 rests on the anvil face 32. Cam 30 encircles the joint between lower impact plate 28 and anvil 40 and may be bolted in place to ensure close contact between anvil face 32 and lower impact plate 28.

The lower end of anvil 40 is designed to accommodate the end of pipe or casing 42. As shown in FIG. 1, pipe or casing 42 may fit inside the lower end of anvil 40, where pipe or casing 42 abuts a shoulder. The lower end of anvil 40 may also fit inside pipe or casing 42, such that the driving device is capable of driving pipes or casing 42 of varying diameters. Impact forces from the hammer 26 are transmitted through the anvil 40 to the uppermost edge of pipe or casing 42, thereby driving pipe or casing 42 into the ground.

For clarity, all parts of the driving device from the lower impact plate 28 and below will be referred to as the lower portion of the driving device. The lower portion of the driving device does not rotate. Friction between the lower surface of the anvil 40 and the pipe or casing 42 prevents anvil 40 from moving with the rotation of drill stem 2.

The driving device further comprises anvil outlet 36, which may be connected to anvil 40 via any suitable means, such as anvil outlet retainer 38. Anvil outlet 36 prevents air inside the pipe or casing 42 from absorbing the impact energy of hammer 26 striking anvil 40. Anvil outlet 36 may also be oriented such that it abuts a portion of the supporting drilling rig, further preventing rotation of the lower portion of the driving device.

The operation of the driving device to install a pipe or casing 42 may be described by reference to FIGS. 3, 3B, 4, 4B, 5 and 5B. In operation, a constant downward force is applied to drill stem 2, in addition to any rotational force. Such downward force is applied through use of pull down chains or like equipment. For example, a weight, which may be on the order of 50,000 pounds, may be attached to drill stem 2. The downward force compresses inner advance spring 12, as shown in FIGS. 3 and 3B, and pre-loads outer hammer spring 22.

Drill stem 2 rotates and advances, causing a similar rotation in carrier 6. Because splines 20 (shown only in FIGS. 3, 4 and 5) connect hammer 26 to carrier. 6, carrier 6 rotation causes hammer 26 to rotate in concert. As cam 30 is bolted to the immovable lower portion of the driving device, the inclined upper surface 54 of cam 30 does not rotate. The inclined lower surface 52 at the lower edge of the diametrically enlarged portion of hammer 26 therefore interacts with the inclined upper edge 54 of cam 30 as hammer 26 rotates. The interaction of the two inclined surfaces 52, 54 forces hammer 26 up towards its extended or loaded position and further compresses spring 22, storing energy. The rotation of hammer 26 continues, until eventually the interacting inclined surfaces 52, 54 reach the point illustrated in FIGS. 3 and 3B, where only small points on the inclined surfaces 52, 54 are in contact with one another. At this point, the driving device is in its fully extended or loaded position.

Figure 3B:
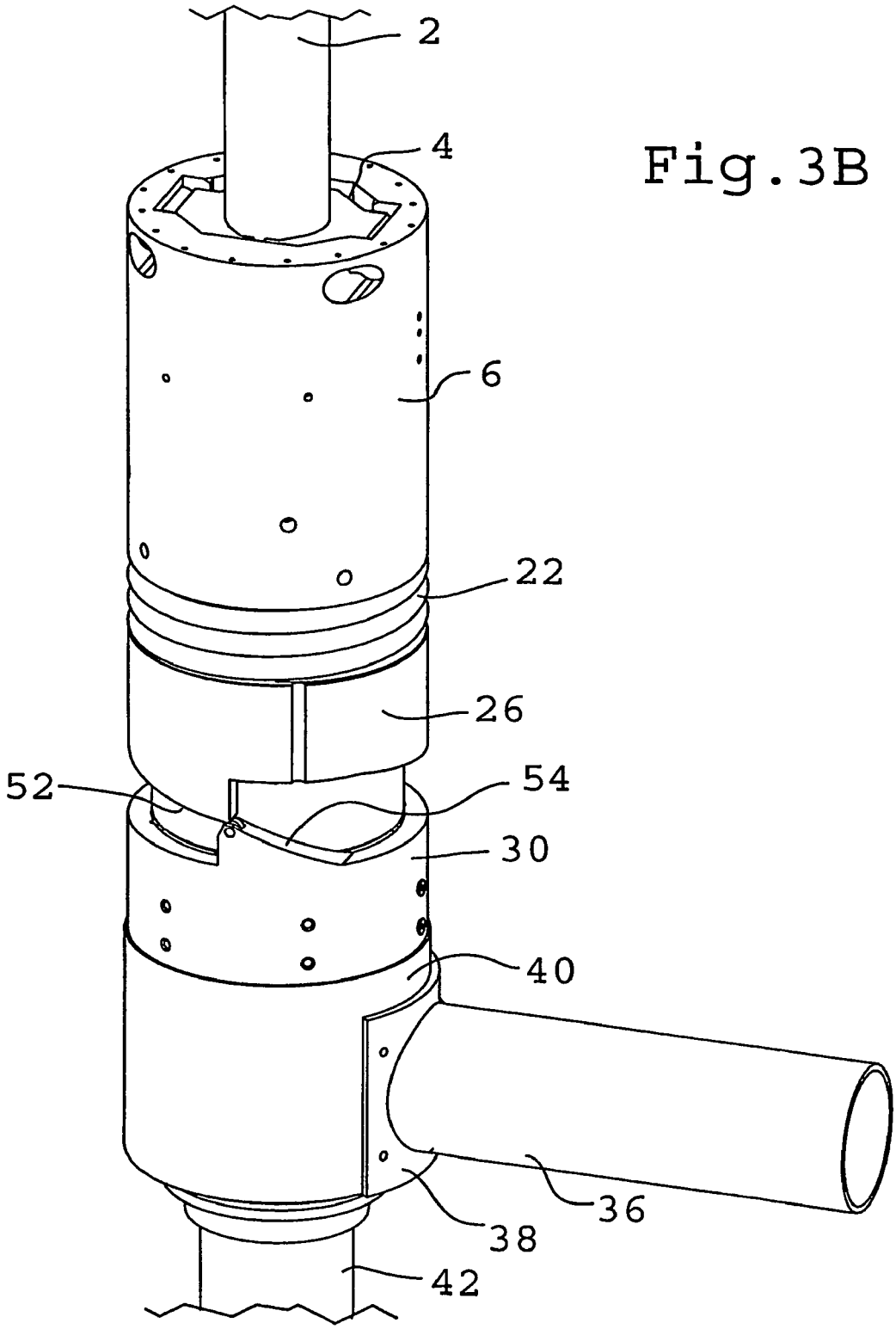
FIG. 3B is a perspective view of the driver of FIG. 1, in an extended, or loaded, position.
Figure 4:
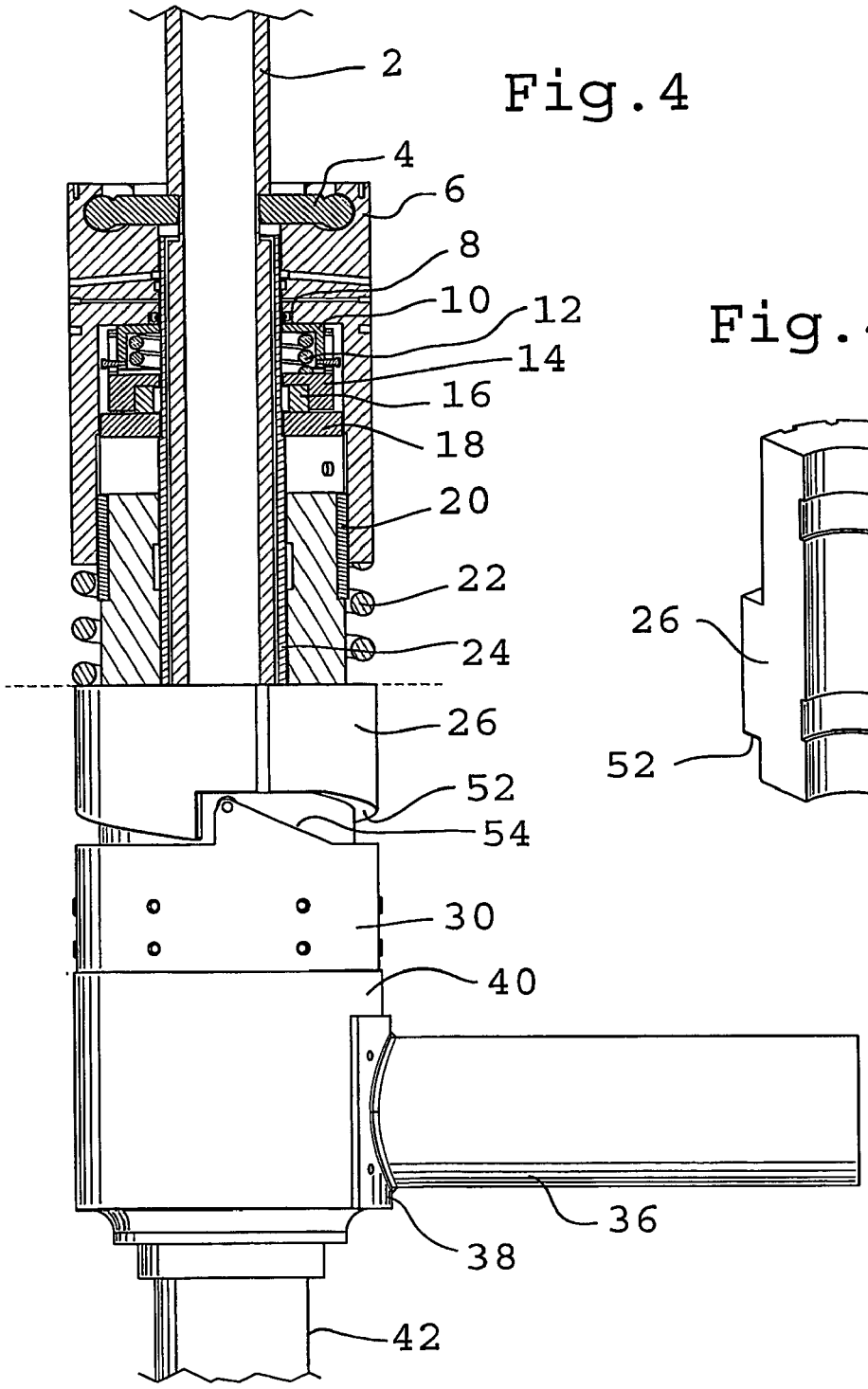
FIG. 4 is a partial sectional view of the driver of FIG. 1, in an impact position.
Figure 4A:
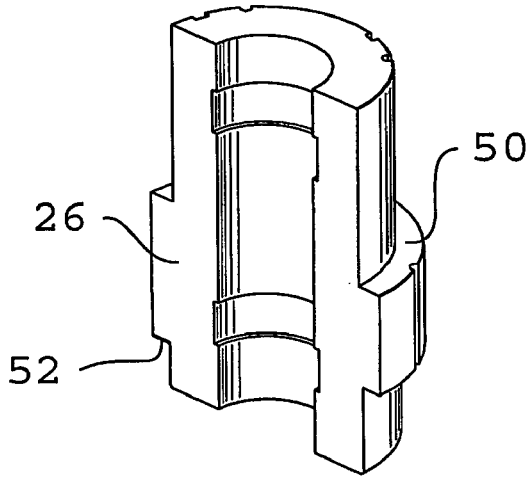
FIG. 4A is a perspective cutaway view of the hammer component of the driver.
Figure 4B:
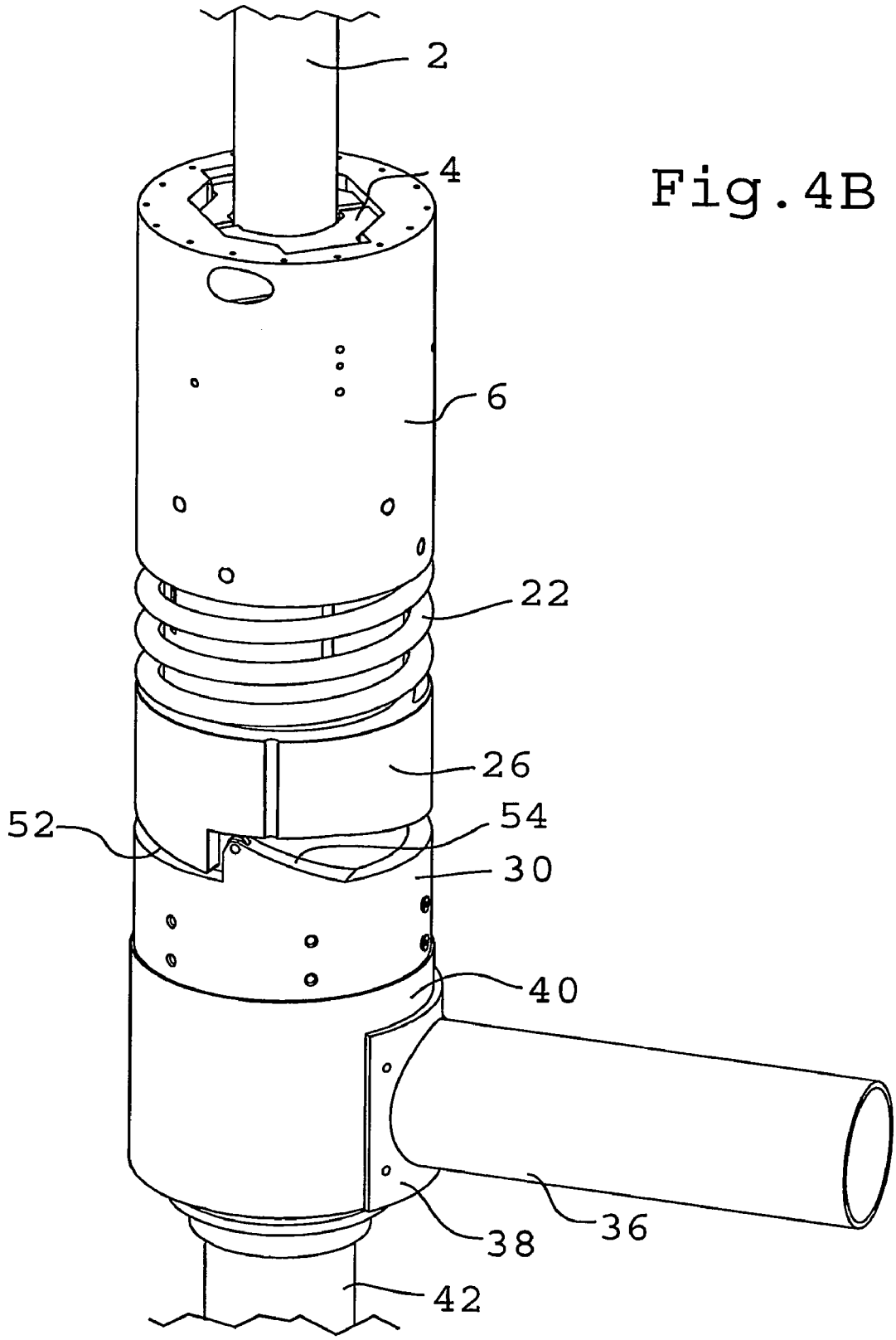
FIG. 4B is a perspective view of the driver of FIG. 1, in an impact position.

Further rotation of the drill stem 2 and the hammer 26 causes the points that were in contact in FIGS. 3 and 3B to slip past each other, as shown in FIGS. 4 and 4B. Upon the sudden release of upward pressure, the lower portion of hammer 26 moves downward rapidly, impacting anvil 40 (through lower impact plate 28, if present) and driving pipe or casing 42 down. Springs 12, 22 are released from compression, adding stored energy to the downward force exerted on pipe or casing 42. The driving device is thus in an impact position.

Figure 5B:
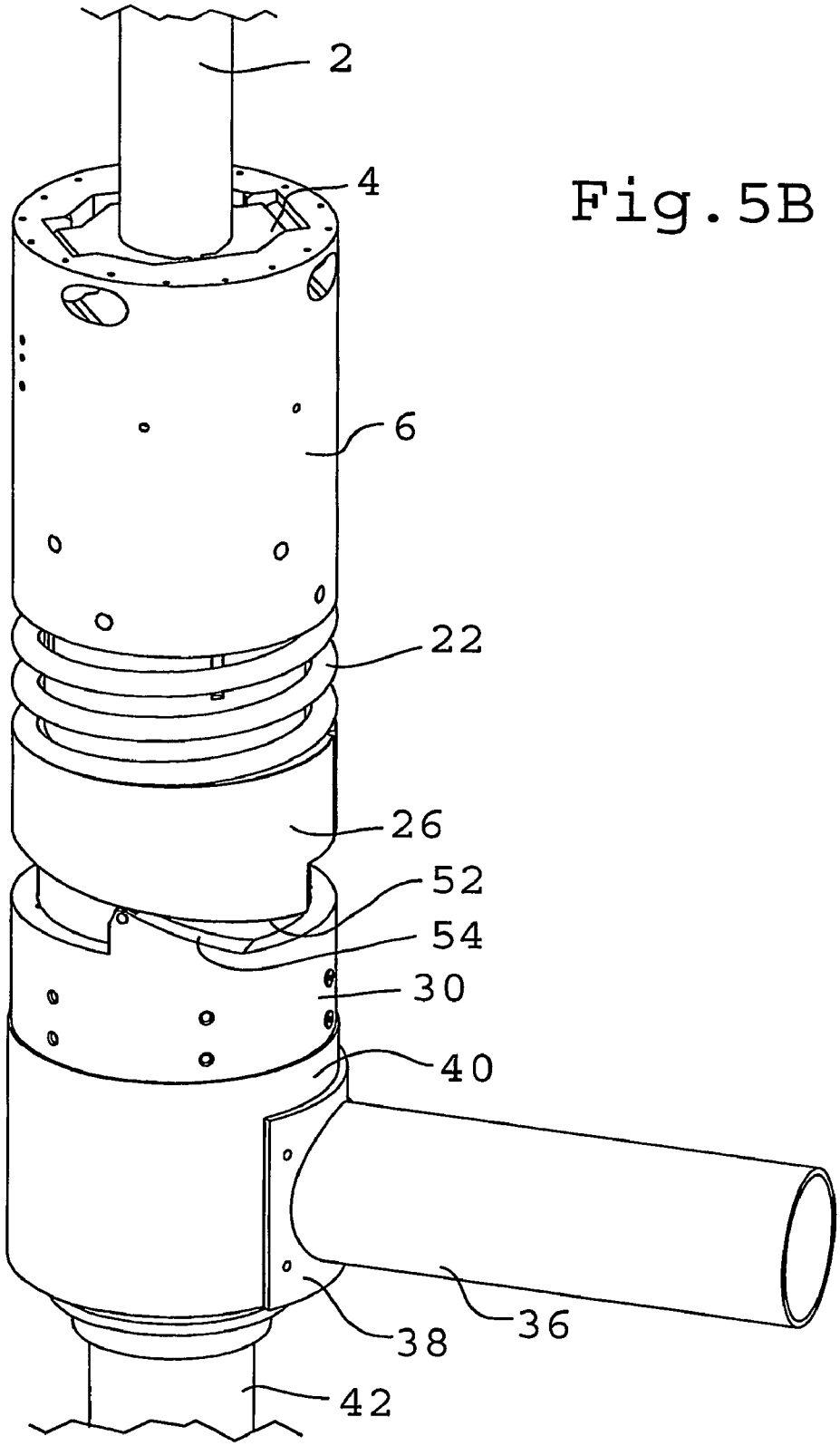
FIG. 5B is a perspective view of the driver of FIG. 1, in a partially loaded position.

Continued rotation of the drill stem 2 and hammer 26 resets the driving device for another blow. The inclined surface 52 of the hammer 26 slides over the inclined surface 54 of cam 30, again compressing the spring 22 and storing energy for the next driving impact. The interaction of the inclined surfaces 52, 54 between blows of the hammer 26, when the device is in a partially loaded position, is best shown in FIGS. 5 and 5B. Because the inclined surface 54 of cam 30 contains two points, the hammer 26 strikes two blows for each rotation of drill stem 2.

During rotation of drill stem 2 between blows, inner advance spring 12 provides a constant downward force on pipe or casing 42, arising from the downward force applied to the drill stem 2. The constant downward force keeps the driving device in constant contact with pipe or casing 42, preventing recoil of the driving device immediately after impact. Recoil prevention is important in order to ensure maximum energy transfer through the driving device, as well as to ensure the lower end of the anvil 40 and the upper end of pipe or casing 42 remain aligned, which could damage both the driving device and pipe or casing 42. The constant downward pressure also keeps pipe or casing 42 moving downward, increasing the efficiency of the driving device and preventing recoil of pipe or casing 42. This is particularly important immediately following impact, when pipe or casing 42 would normally tend to rebound out of the ground.

It will be appreciated by those skilled in the art that other variations to the preferred embodiment described herein may be practised without departing from the scope of the invention, such scope being properly defined by the following claims.

The invention claimed is:

1. A device for installing a pipe or casing, using an external driver, comprising:

a first portion adapted to capture an axial rotational force supplied by said external driver along a central axis;

a second portion adapted to store energy derived from said rotational force and to convert said energy to an impact force; and a third portion adapted to transmit said impact force to said pipe or casing.

2. The device of claim 1 wherein said external driver is a rotary drill stem.

3. The device of claim 1 wherein said first portion comprises:

a carrier device surrounding a section of said external driver; and means to connect said carrier device to said external driver.

4. The device of claim 3 wherein said means to connect said carrier device comprises clamps to directly engage said external driver.

5. The device of claim 3 wherein said means to connect said carrier device comprises slips to directly engage said driver.

6. The device of claim 3 wherein said carrier device comprises a generally hollow cylinder, adapted to accommodate a section of said external driver through an axially central aperture and to accommodate part of said second portion of said device.

7. The device of claim 1 wherein said first portion is further adapted to capture a downward force applied to said external driver, to store said captured downward force, and to transmit said stored downward force to said pipe or casing.

8. The device of claim 7 wherein said downward force is captured, stored and transmitted by one or more springs.

9. The device of claim 7 where said transmittal of said downward force is essentially constant as said pipe or casing is installed.

10. The device of claim 1 wherein said second portion comprises:

an upper portion which rotates about said central axis under said rotational force; and a lower portion.

11. The device of claim 10 wherein said upper portion further comprises a downward facing inclined surface.

12. The device of claim 11 wherein said lower portion further comprises an upward facing inclined surface.

13. The device of claim 12 wherein said inclined surfaces cooperate to move said upper portion away from said lower portion along said central axis upon partial rotation of said upper and lower portions, and further cooperate to allow said upper portion to move back towards said lower portion along said central axis upon further relative rotation of said upper and lower portions.

14. The device of claim 13 wherein said further cooperation comprises a sudden cessation of direct contact between said inclined surfaces.

15. The device of claim 14 further comprising at least one spring, said at least one spring being adapted to compress when said upper portion moves away from said lower portion and adapted to expand when said upper portion moves back towards said lower portion.

16. The device of claim 1 wherein said third portion comprises:

an upper surface, adapted to receive said impact force from said second portion; and a lower surface in direct contact with an uppermost part of said pipe or casing.

17. The device of claim 16 wherein said third portion further comprises an outlet to allow air to escape from said third portion.

18. The device of claim 1 further comprising a fourth portion, said fourth portion comprising a shaft shaped to encircle said external driver while fitting within said first, second and third portions along said central axis.

19. A method of installing a pipe or casing, comprising:

capturing rotational force supplied by an external driver;

storing energy derived from said rotational force;

converting said energy to an impact force; and transmitting said impact force to said pipe or casing.

20. The method of claim 19, further comprising:

capturing a downward force applied to said external driver; and transmitting said downward force to said pipe or casing.

21. A device for installing a pipe or casing using an external rotary driver which produces a rotational force, comprising:

means to directly connect said device to said external rotary driver;

a central shaft encircling a portion of said external rotary driver; a hammer;

an anvil;

one or more springs;

a generally cylindrical carrier device;

wherein said carrier device and said hammer are operatively connected to rotate in concert under said rotational force;

wherein said rotational force causes said hammer to provide a first impact force to said anvil; and wherein said first impact force causes said anvil to provide a second impact force to said pipe or casing.

22. The device of claim 21 wherein said means to connect said device to said external rotary driver comprises clamps.

23. The device of claim 21 wherein said means to connect said device to said external rotary driver comprises slips.

24. The device of claim 21 wherein a downward force is applied to said external rotary driver, and further comprising:

one or more springs adapted to capture said downward force; and to transmit said downward force to said pipe or casing.

25. The device of claim 24 where said transmittal of said downward force is essentially constant as said pipe or casing is installed.

26. A device for installing a pipe or casing, using an external driver, comprising:

a first portion adapted to capture an axial rotational force supplied by said external driver along a central axis; and a second portion adapted to store energy derived from said rotational force, to convert said energy to an impact force and to transmit said impact force to said pipe or casing.

27. The device of claim 26 wherein said external driver is a rotary drill stem.

28. The device of claim 26 wherein said first portion comprises:

a carrier device surrounding a section of said external driver; and means to connect said carrier device to said external driver.

29. The device of claim 28 wherein said means to connect said carrier device comprises clamps to directly engage said external driver.

30. The device of claim 28 wherein said means to connect said carrier device comprises slips to directly engage said driver.

31. The device of claim 28 wherein said carrier device comprises a generally hollow cylinder, adapted to accommodate a section of said external driver through an axially central aperture and to accommodate part or all of said second portion of said device.

32. The device of claim 26 wherein said second portion comprises:

an upper portion which rotates about said central axis under said rotational force; and a lower portion.

33. The device of claim 32 wherein said upper portion further comprises a downward facing inclined surface.

34. The device of claim 33 wherein said lower portion further comprises an upward facing inclined surface.

35. The device of claim 34 wherein said inclined surfaces cooperate to move said upper portion away from said lower portion along said central axis upon partial rotation of said upper and lower portions, and further cooperate to allow said upper portion to move back towards said lower portion along said central axis upon further relative rotation of said upper and lower portions.

36. The device of claim 35 wherein said further cooperation comprises a sudden cessation of direct contact between said inclined surfaces.

37. The device of claim 36 further comprising at least one spring, said at least one spring being adapted to compress when said upper portion moves away from said lower portion and adapted to expand when said upper portion moves back towards said lower portion.

38. The device of claim 26 wherein said second portion further comprises an outlet to allow air to escape from said second portion.

39. The device of claim 26 further comprising a third portion, said third portion comprising a shaft shaped to encircle said external driver while fitting within said first and second portions along said central axis.

40. The device of claim 26 wherein a downward force is applied to said external driver, and further comprising:

one or more springs adapted to capture said downward force; and to transmit said downward force to said pipe or casing.

41. The device of claim 40 where said transmittal of said downward force is essentially constant as said pipe or casing is installed.

* * * * *